US011225876B2

(12) United States Patent
Jin et al.

(10) Patent No.: US 11,225,876 B2
(45) Date of Patent: Jan. 18, 2022

(54) DIFFUSION BARRIER TO PREVENT SUPER ALLOY DEPLETION INTO NICKEL-CBN BLADE TIP COATING

(71) Applicant: United Technologies Corporation, Farmington, CT (US)

(72) Inventors: Lei Jin, Unionville, CT (US); William J. Joost, Worcester, MA (US); Ryan M. Brodeur, Southwick, MA (US)

(73) Assignee: Raytheon Technologies Corporation, Farmington, CT (US)

( * ) Notice: Subject to any disclaimer, the term of this patent is extended or adjusted under 35 U.S.C. 154(b) by 94 days.

(21) Appl. No.: 16/720,844

(22) Filed: Dec. 19, 2019

(65) Prior Publication Data

US 2021/0189890 A1 Jun. 24, 2021

(51) Int. Cl.

| | |
|---|---|
| ***F01D 5/28*** | (2006.01) |
| ***F01D 5/02*** | (2006.01) |
| ***C25D 3/56*** | (2006.01) |
| ***C25D 5/50*** | (2006.01) |

(52) U.S. Cl.

CPC ..... *F01D 5/288* (2013.01); *C25D 3/562* (2013.01); *C25D 5/50* (2013.01); *F01D 5/02* (2013.01); *F05D 2230/90* (2013.01); *F05D 2240/307* (2013.01); *F05D 2300/17* (2013.01)

(58) Field of Classification Search

CPC ..... F01D 5/288; F01D 5/02; F05D 2230/90; F05D 2300/611; F05D 2300/6111; F05D 2300/17; F05D 2240/30; F05D 2240/307; C25D 5/50; C25D 5/14; C25D 3/562; C25D 15/00; C23C 28/00–44

USPC ..... 416/241 R, 241 A, 241 B

See application file for complete search history.

(56) References Cited

U.S. PATENT DOCUMENTS

| | | | | |
|---|---|---|---|---|
| 5,389,228 | A | 2/1995 | Long et al. | |
| 2002/0197155 | A1 | 12/2002 | Howard et al. | |
| 2004/0137229 | A1 | 7/2004 | Mudholkar et al. | |
| 2007/0054126 | A1* | 3/2007 | Yasui | C23C 28/34 428/411.1 |
| 2012/0099968 | A1 | 4/2012 | Zajchowski et al. | |
| 2014/0178699 | A1 | 6/2014 | Widmer et al. | |
| 2016/0237581 | A1 | 8/2016 | Foster et al. | |
| 2016/0298467 | A1* | 10/2016 | Ucasz | C23C 4/134 |
| 2018/0002812 | A1* | 1/2018 | Watanabe | F02M 26/04 |

(Continued)

FOREIGN PATENT DOCUMENTS

| | | | |
|---|---|---|---|
| EP | 24445413 | A1 | 4/2012 |
| EP | 3186414 | A1 | 7/2017 |

(Continued)

OTHER PUBLICATIONS

EP Search Report dated Feb. 4, 2021 issued for corresponding European Patent Application No. 202115985.1.

(Continued)

*Primary Examiner* — Mark A Laurenzi
*Assistant Examiner* — Xiaoting Hu
(74) *Attorney, Agent, or Firm* — Bachman & LaPointe, P.C.

(57) ABSTRACT

A diffusion barrier coating on a nickel-based alloy substrate comprising the diffusion barrier being coupled to the substrate between the substrate and a composite material opposite the substrate, wherein the diffusion barrier comprises a nickel phosphorus alloy material.

11 Claims, 2 Drawing Sheets

(56) References Cited

U.S. PATENT DOCUMENTS

| | | | | |
|---|---|---|---|---|
| 2018/0171483 | A1* | 6/2018 | Nambu | C23C 18/32 |
| 2018/0195192 | A1 | 7/2018 | Martel et al. | |
| 2018/0216478 | A1* | 8/2018 | Martel | F01D 11/122 |

FOREIGN PATENT DOCUMENTS

| | | | |
|---|---|---|---|
| EP | 3346029 | A1 | 7/2018 |
| EP | 3358143 | A1 | 8/2018 |
| GB | 2475850 | A | 6/2011 |
| GB | 2551527 | A | 12/2017 |
| WO | 2016033301 | A1 | 3/2016 |

OTHER PUBLICATIONS

EP Search Report dated Mar. 25, 2021 issued for corresponding European Patent Application No. 20216159.2.

* cited by examiner

DIFFUSION BARRIER TO PREVENT SUPER ALLOY DEPLETION INTO NICKEL-CBN BLADE TIP COATING

BACKGROUND

The present disclosure is directed to a diffusion barrier layer for integrally bladed rotor tip Nickel-Cubic Boron Nitride (Ni—CBN) coating.

In certain gas turbine engines, the nickel integrally bladed rotor is suffering lost life time of the tip Ni—CBN coating. Elements of the base super alloy diffuse from the base super alloy into the Ni—CBN layer after engine run or heat treatment. Elements such as Cr and Al diffuse from the base super alloy into the Ni—CBN coating layer.

As a result of the diffusion of the elements from the base super alloy and the propensity of these elements to oxidize during engine operation, oxides form along surfaces and grain boundaries within the coating. These oxides reduce the strength of the coating causing loss of CBN particles and recession of the coating.

What is needed is a technique to diminish the diffusion and subsequent nickel alloy depletion.

SUMMARY

In accordance with the present disclosure, there is provided a diffusion barrier coating on a nickel-based alloy substrate comprising the diffusion barrier coupled to the substrate between the substrate and a composite material opposite the substrate, wherein the diffusion barrier comprises a nickel phosphorus alloy material.

In another embodiment, the diffusion barrier comprises a twisted grain orientation in the absence of columnar grain orientation.

In another embodiment, the nickel phosphorus alloy material comprises a lamellar layer coating.

In another embodiment, the diffusion barrier consists of plated layers.

In another embodiment, the lamellar layer coating comprises a lamellar structure that includes multiple layers.

In another embodiment, the composite material comprises a nickel-cubic boron nitride material.

In another embodiment, the diffusion barrier comprises a bond coat between the substrate and the composite material.

In accordance with the present disclosure, there is provided a gas turbine engine component comprising a compressor integrally bladed rotor having a blade with an airfoil section and a tip having a substrate; a diffusion barrier coupled to the substrate between the substrate and a composite material opposite the substrate, wherein the diffusion barrier comprises a nickel phosphorus alloy material.

In another embodiment, the nickel phosphorus alloy material comprises a lamellar layer coating.

In another embodiment, the lamellar layer coating comprises a lamellar structure that includes multiple layers.

In another embodiment, the diffusion barrier lamellar layer coating comprises a twisted grain orientation in the absence of columnar grain orientation.

In another embodiment, the substrate comprises a nickel-based alloy.

In another embodiment, the integrally bladed rotor is located in a high pressure compressor section of the gas turbine engine.

In accordance with the present disclosure, there is provided a process for diffusion inhibition in a nickel-based alloy substrate of a gas turbine engine component comprising applying a diffusion barrier coupled to the substrate, wherein the diffusion barrier comprises a nickel phosphorus alloy material; coating the diffusion barrier with a matrix composite; and subjecting the gas turbine engine component with nickel-based alloy substrate to at least one of a heat treatment and an engine operation.

In another embodiment, the process further comprises coating the nickel phosphorus alloy material as a lamellar layer coating.

In another embodiment, the lamellar layer coating comprises coating as a lamellar structure that includes multiple layers.

In another embodiment, the diffusion barrier comprises a twisted grain orientation in the absence of columnar grain orientation.

In another embodiment, the process further comprises plating the diffusion barrier in layers.

In another embodiment, the matrix composite material comprises a nickel-cubic boron nitride material.

In another embodiment, the process further comprises preventing Cr, Al, and Ti depletion from the nickel-based alloy substrate by reducing diffusion between the nickel-based alloy substrate and the matrix composite with the diffusion barrier.

Other details of the diffusion barrier are set forth in the following detailed description and the accompanying drawings wherein like reference numerals depict like elements.

DETAILED DESCRIPTION

Figure 1:
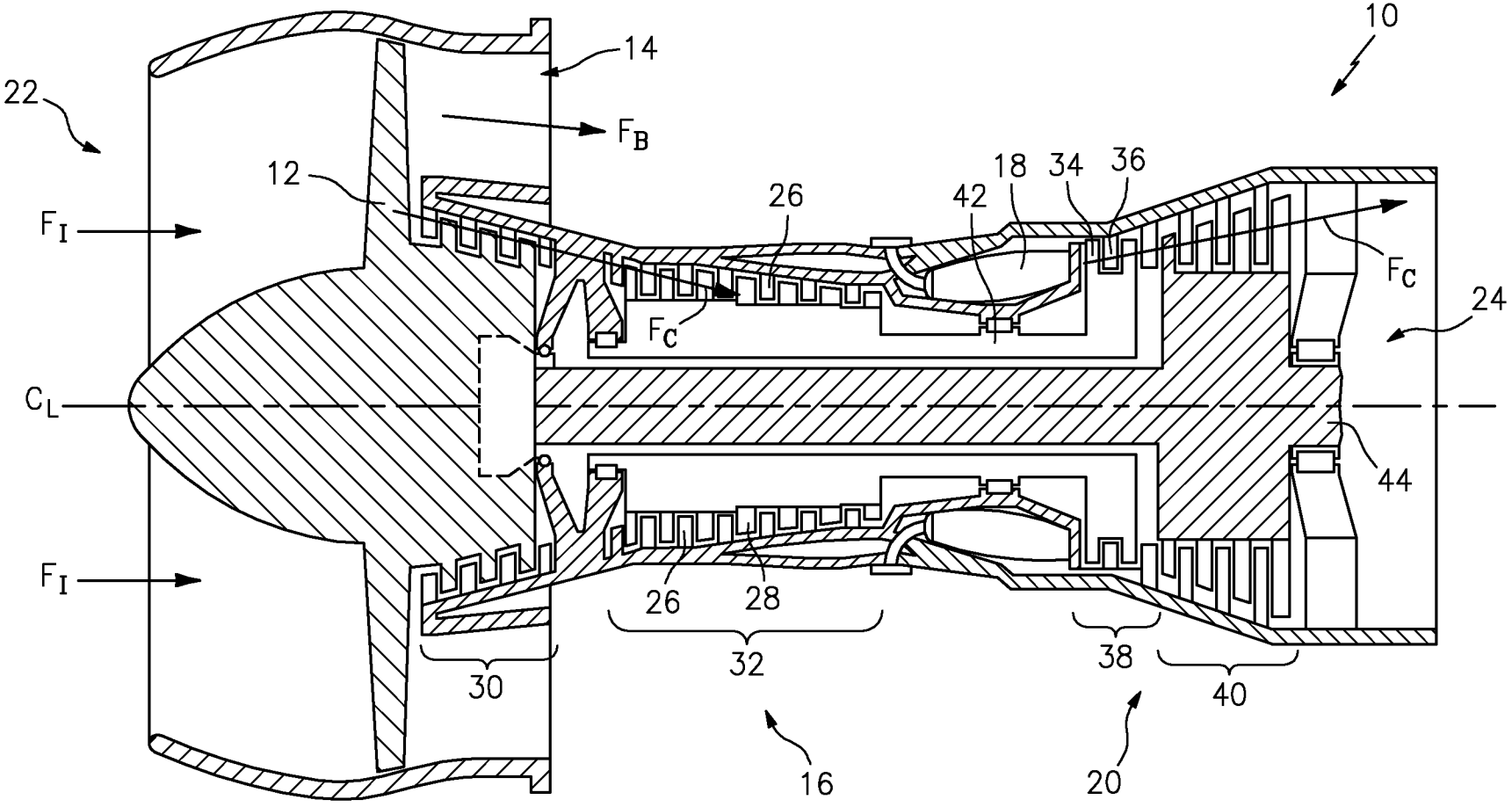
FIG. 1 is a simplified cross-sectional view of a gas turbine engine.

FIG. 1 is a simplified cross-sectional view of a gas turbine engine 10 in accordance with embodiments of the present disclosure. Turbine engine 10 includes fan 12 positioned in bypass duct 14. Turbine engine 10 also includes compressor section 16, combustor (or combustors) 18, and turbine section 20 arranged in a flow series with upstream inlet 22 and downstream exhaust 24. During the operation of turbine engine 10, incoming airflow $F_I$ enters inlet 22 and divides into core flow $F_C$ and bypass flow $F_B$, downstream of fan 12. Core flow $F_C$ continues along the core flowpath through compressor section 16, combustor 18, and turbine section 20, and bypass flow $F_B$ proceeds along the bypass flowpath through bypass duct 14.

Compressor 16 includes stages of compressor vanes 26 and blades 28 arranged in low pressure compressor (LPC) section 30 and high pressure compressor (HPC) section 32. Turbine section 20 includes stages of turbine vanes 34 and turbine blades 36 arranged in high pressure turbine (HPT) section 38 and low pressure turbine (LPT) section 40. HPT section 38 is coupled to HPC section 32 via HPT shaft 42, forming the high pressure spool. LPT section 40 is coupled to LPC section 30 and fan 12 via LPT shaft 44, forming the low pressure spool. HPT shaft 42 and LPT shaft 44 are typically coaxially mounted, with the high and low pressure spools independently rotating about turbine axis (centerline) $C_L$.

Combustion gas exits combustor 18 and enters HPT section 38 of turbine 20, encountering turbine vanes 34 and turbines blades 36. Turbine vanes 34 turn and accelerate the flow of combustion gas, and turbine blades 36 generate lift for conversion to rotational energy via HPT shaft 42, driving HPC section 32 of compressor 16. Partially expanded combustion gas flows from HPT section 38 to LPT section 40, driving LPC section 30 and fan 12 via LPT shaft 44. Exhaust flow exits LPT section 40 and turbine engine 10 via exhaust nozzle 24. In this manner, the thermodynamic efficiency of turbine engine 10 is tied to the overall pressure ratio (OPR), as defined between the delivery pressure at inlet 22 and the compressed air pressure entering combustor 18 from compressor section 16. As discussed above, a higher OPR offers increased efficiency and improved performance. It will be appreciated that various other types of turbine engines can be used in accordance with the embodiments of the present disclosure.

Figure 2:
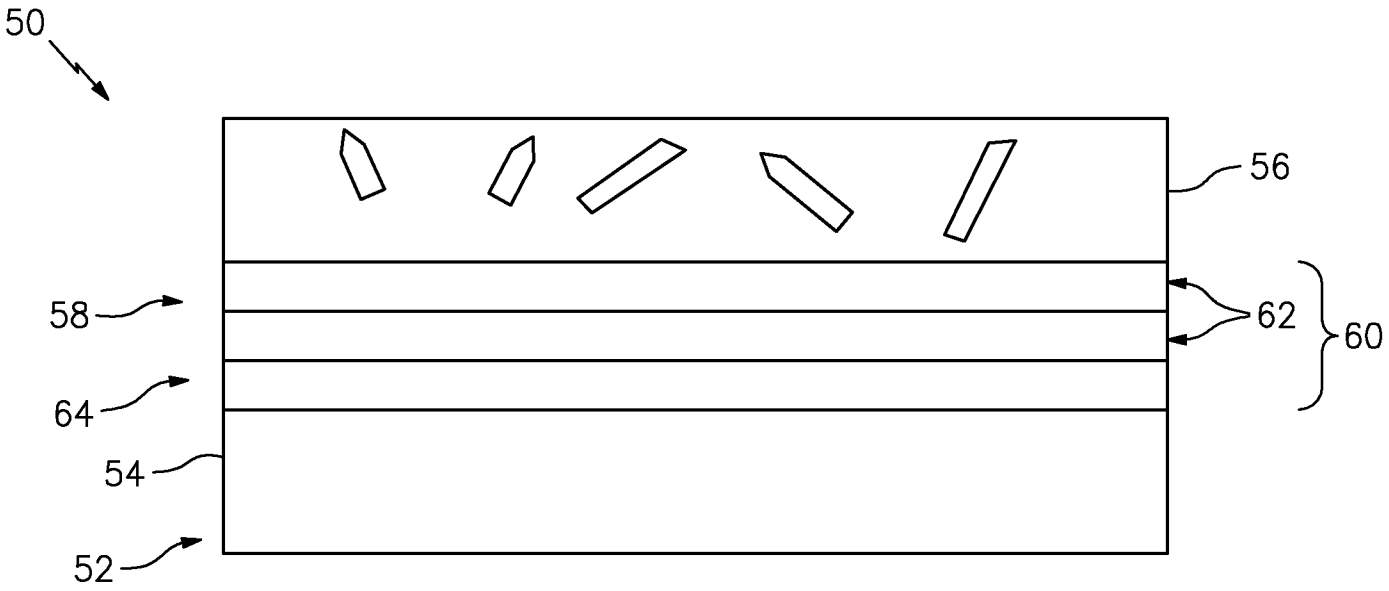
FIG. 2 is a cross sectional schematic of an exemplary coating system.

Referring now to FIG. 2, there is illustrated a turbine engine component 50, such as a compressor integrally bladed rotor or blade or vane, and the like. The component 50 can be an integrally bladed rotor in the high pressure compressor section 32 of the gas turbine engine 10. The turbine engine component 50 has an airfoil portion 52 with a tip 54.

The turbine engine component 50 may be formed from a titanium-based alloy or a nickel-based alloy. On the substrate tip 54 of the airfoil portion 52, a composite material 56 is applied for rub and abradability against an abradable coating (not shown). In an exemplary embodiment the composite material 56 can be a nickel-cubic boron nitride (Ni—CBN) material.

A diffusion barrier 58 can be coupled to the tip substrate 54 between the tip substrate 54 and the composite material 56. In an exemplary embodiment, the diffusion barrier 58 comprises a nickel phosphorus alloy (Ni—P) coating. The nickel phosphorus alloy coating 58 can be applied in a fashion to form a lamellar layer coating 60. The diffusion barrier 58 can be plated in layers. The lamellar layer coating 60 has a lamellar structure that include multiple layers 62 with a twisted grain orientation instead of and in the absence of columnar grain structures. In an exemplary embodiment, a pure nickel layer can act as a bond coat 64. The lamellar structure provides the technical advantage of inhibiting the diffusion of elements from the substrate of the tip 54.

In an exemplary embodiment, the lamellar layer coating 60 can replace the traditional columnar structure of prior coating systems. Diffusion of the super alloy elements (esp. Cr, Al, Ti) occurs readily along grain boundaries in the Ni component of the Ni—CBN coating. The columnar structure (not shown) results in grain boundaries aligned through the thickness of the Ni—CBN coating, results in rapid diffusion through the coating. The lamellar layer coating 60 results in grain boundaries aligned with the blade tip surface, dramatically reducing available rapid diffusion pathways through the coating thickness.

A technical advantage of the diffusion barrier with lamellar layer structure is that it prevents Cr, Al, and Ti depletion from the base alloy of the substrate.

Another technical advantage of the diffusion barrier includes formation of a very thin, uniform and homogenous oxidation layer (0.1 mil), that indicates a high corrosion/oxidation resistant property.

Another technical advantage of the diffusion barrier includes very low grain boundary oxidation.

Another technical advantage of the disclosed diffusion barrier includes prevention of the Ni super alloy depletion after engine operation.

Another technical advantage of the disclosed diffusion barrier includes elimination of potential mechanical strength reduction due to the depletion of the alloy chemistry.

Another technical advantage of the disclosed diffusion barrier includes extending the lifetime of the IBR used in the HPC section.

There has been provided a diffusion barrier. While the diffusion barrier has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A diffusion barrier coating on a nickel-based alloy substrate comprising:

the diffusion barrier coupled to the substrate between the substrate and a composite material opposite the substrate, wherein the diffusion barrier comprises a nickel phosphorus alloy material configured as a lamellar layer coating comprising a lamellar structure that includes multiple layers with grain boundaries having a twisted grain boundary orientation instead of and in the absence of columnar grain structures, wherein said grain boundaries are aligned with a surface of the substrate.

2. The diffusion barrier coating on a substrate according to claim 1, wherein said diffusion barrier consists of plated layers.

3. The diffusion barrier coating on a substrate according to claim 1, wherein said composite material comprises a nickel-cubic boron nitride material.

4. The diffusion barrier coating on a substrate according to claim 1, wherein said diffusion barrier comprises a bond coat between said substrate and said composite material.

5. A gas turbine engine component comprising:

a compressor integrally bladed rotor having a blade with an airfoil section and a tip having a substrate;

a diffusion barrier coupled to the substrate between the substrate and a composite material opposite the substrate, wherein the diffusion barrier comprises a nickel phosphorus alloy material configured as a lamellar layer coating comprising a lamellar structure that includes multiple layers with grain boundaries having a twisted grain boundary orientation instead of and in the absence of columnar grain structures, wherein said grain boundaries are aligned with a surface of the tip.

6. The gas turbine engine component according to claim 5, wherein said substrate comprises a nickel-based alloy.

7. The gas turbine engine component according to claim 5, wherein said integrally bladed rotor is located in a high pressure compressor section of the gas turbine engine.

8. A process for diffusion inhibition in a nickel-based alloy substrate of a gas turbine engine component comprising:

applying a diffusion barrier coupled to the substrate, wherein the diffusion barrier comprises a nickel phosphorus alloy material configured as a lamellar layer coating comprising a lamellar structure that includes multiple layers with grain boundaries having a twisted grain boundary orientation instead of and in the absence of columnar grain structures;

wherein said grain boundaries are aligned with a surface of said nickel-based alloy substrate, reducing available rapid diffusion pathways through the diffusion barrier thickness;

coating said diffusion barrier with a matrix composite; and subjecting said gas turbine engine component with nickel-based alloy substrate to at least one of a heat treatment and an engine operation.

9. The process of claim 8, further comprising:

plating the diffusion barrier in layers.

10. The process of claim 8, wherein said matrix composite comprises a nickel-cubic boron nitride material.

11. The process of claim 8, further comprising: preventing Cr, Al, and Ti depletion from the nickel-based alloy substrate by reducing diffusion between said nickel-based alloy substrate and said matrix composite with said diffusion barrier, wherein said preventing Cr, Al, and Ti depletion comprises said reducing available rapid diffusion pathways through the diffusion barrier thickness by aligning said grain boundaries with the surface of said nickel-based alloy substrate.

* * * * *